US009233288B1

(12) United States Patent
Cox

(10) Patent No.: US 9,233,288 B1
(45) Date of Patent: Jan. 12, 2016

(54) KAVEMAN GOLFE SYSTEMS

(71) Applicant: Michael Cox, Brushton, NY (US)

(72) Inventor: Michael Cox, Brushton, NY (US)

( * ) Notice: Subject to any disclaimer, the term of this patent is extended or adjusted under 35 U.S.C. 154(b) by 213 days.

(21) Appl. No.: 14/061,732

(22) Filed: Oct. 23, 2013

Related U.S. Application Data

(60) Provisional application No. 61/727,223, filed on Nov. 16, 2012.

(51) Int. Cl.
*A63B 67/02* (2006.01)

(52) U.S. Cl.
CPC ..... *A63B 67/02* (2013.01)

(58) Field of Classification Search
CPC ..... A63B 67/002; A63B 67/06; A63B 67/02
USPC ..... 473/416, 465–474, 167–170, 185
See application file for complete search history.

(56) References Cited

U.S. PATENT DOCUMENTS 1,911,569 A * 5/1933 Hinckley ..... A63B 37/02 473/468
2,144,846 A * 1/1939 Kruspe ..... A63B 53/00 273/129 R
3,904,209 A 9/1975 Thomas
4,026,561 A 5/1977 Baldorossi
4,413,827 A 11/1983 Aberg
4,660,834 A 4/1987 Carrigan
4,805,583 A * 2/1989 Mosser ..... A63B 53/00 124/17
4,988,105 A 1/1991 Perry
5,470,055 A * 11/1995 Ritchie ..... A63B 69/0002 473/215
5,490,671 A 2/1996 Picard
D410,715 S * 6/1999 Cramton ..... D21/715
6,200,234 B1 * 3/2001 Hannon ..... A63B 67/002 473/410
6,749,528 B2 * 6/2004 Wengert ..... A63B 69/36 124/16
7,056,235 B2 * 6/2006 MacDonald ..... A63B 53/04 473/324
7,101,293 B2 * 9/2006 Tarng ..... A63H 33/18 273/400
2005/0282665 A1 * 12/2005 Tarng ..... A63H 33/18 473/465
2007/0037636 A1 * 2/2007 Wong ..... A63B 43/04 473/415
2007/0102884 A1 * 5/2007 Hinz ..... A63B 67/002 273/348
2010/0099508 A1 * 4/2010 Wolf ..... A63B 53/007 473/195

* cited by examiner

*Primary Examiner* — Mark Graham
(74) *Attorney, Agent, or Firm* — RG Patent Consulting, LLC; Rachel Gilboy

(57) ABSTRACT

Kaveman Golfe Systems is a golf-like game incorporating the use of a newly designed baseball-style club in addition to newly designed golf clubs for advancing a game ball about a golf-style course. The golf and baseball hybrid game may be played using newly designed golf balls which are larger in size than a standard sized golf ball. The game may further include a newly designed baseball tee for vertically supporting the golf and baseball hybrid game ball to be struck by a player using a baseball-style swing. The clubs, balls, and tees may be stored in a specially designed golf bag.

18 Claims, 6 Drawing Sheets

KAVEMAN GOLFE SYSTEMS

CROSS-REFERENCE TO RELATED APPLICATION

The present application is related to and claims priority from prior provisional application Ser. No. 61/727,223, filed Nov. 16, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of golf games and more specifically relates to a novel game combining the sports of golf and baseball into a fun, exciting, and unique game.

2. Description of the Related Art

Baseball is America's pastime. The classic sport inspires memories of great athletes, unbelievable plays, and childhood dreams. Children often grow up playing the sport from an early age and become fans of the MLB. They root for a favorite team, attend live games, and play the sport with their friends and family. From little league on up, the sport of baseball is loved and played by millions across the world.

Likewise, golf is a sport growing in popularity. While many may consider golf a sport for middle-aged Caucasian men, a look at the PGA reveals countless new youthful faces each and every year. Golf is a sport played in middle school, high school, and university, and those who play the sport tend to fall in love with it. Although it may be incredibly agonizing at times, golfers of all skill levels feel an exuberating thrill when a great tee-shot is hit or a long putt is sunk.

People are always looking for new games to play, however each game/sport typically combines distinct elements, which may be difficult or confusing as a new game. For example, baseball requires power and strength while golf often necessitates finesse and accuracy. A new game combining all elements would certainly be enjoyable to many.

Various attempts have been made to solve the above-mentioned problems such as those found in U.S. Pat. No. 4,026,561 to Blance N. Baldorossi, U.S. Pat. No. 4,413,827 to Erik O. Aberg, U.S. Pat. No. 5,490,671 to Roy W. Picard, U.S. Pat. No. 4,660,834 to Andrew J. Carrigan, U.S. Pat. No. 4,988,105 to Ralph Bery, and U.S. Pat. No. 3,904,209 to Clarence A. Thomas. This art is representative of hybrid golf games. None of the above inventions and patents, taken either singly or in combination, is seen to describe the invention as claimed.

Ideally, the Kaveman Golfe System should provide a user-friendly game providing a fun and different way to play a unique game on a rugged or non-rugged terrain, and, yet would operate reliably and be manufactured at a modest expense. Thus, a need exists for Kaveman Golfe Systems to avoid the above-mentioned problems.

BRIEF SUMMARY OF THE INVENTION

In view of the foregoing disadvantages inherent in the golf and baseball game art, the present invention provides a novel golf and baseball hybrid game. The general purpose of the present invention, which will be described subsequently in greater detail, is to provide a unique and entertaining game that combines elements of baseball within a framework of golf.

A golf and baseball hybrid game is disclosed herein which is played with at least one golf and baseball hybrid game ball. The golf and baseball hybrid game ball preferably comprises dimensions of approximately 2" to 3" in diameter, such that it larger in size than a traditional golf ball which may make the golf and baseball hybrid game ball more readily visible during play.

The golf and baseball hybrid game comprises at least one set of golf clubs. The set of golf clubs comprises at least one club useful for approach shots, at least one wedge club useful for hazards and rough terrain via a golf-style swing, at least one putter useful for striking the golf and baseball hybrid game ball when on a green area of the hybrid golf and baseball game course, and at least one driver useful for driving the golf and baseball hybrid game ball approximately 100-200 yards via the golf-style swing. In addition to the set of golf clubs, the golf and baseball hybrid game comprises at least one baseball-style club useful for approach shots and also for advancing the golf and baseball hybrid game ball approximately 100-200 yards via a baseball-style swing.

The golf and baseball hybrid game further comprises at least one golf tee and at least one baseball tee. The golf tee comprises a standard golf tee useful for holding the golf and baseball hybrid game ball an inch or two off the ground. The baseball tee may comprise a spring mounted to a top which may be useful for flexibly holding the golf and baseball hybrid game ball during the baseball-style swing. Further, the baseball tee may be vertically adjustable to accommodate a relative stature of the first player and the second player. The golf and baseball hybrid game further comprises at least one hybrid club bag along with a set of golf and baseball hybrid game rules defining regulations and objectives of the golf and baseball hybrid game.

The hybrid golf and baseball game course comprises a plurality of hybrid golf and baseball game holes numbered in a sequential order. In one version, the hybrid golf and baseball game course may have eleven of the holes. With reference to the course itself, the hybrid golf and baseball game course may comprise rugged terrain (such as frequent elevation changes and physical obstructions, both artificial and natural). Alternatively, the hybrid golf and baseball game course may comprise non-rugged terrain. The style of terrain may determine the relative skill required. Non-rugged terrain may be more suitable for older players or those not in as good of physical conditioning.

With particular reference to the components of the game, the set of golf clubs, the baseball-style club(s), the golf tee, the baseball tee, the golf and baseball hybrid game ball, the hybrid club bag, and the hybrid golf and baseball game course comprises in combination the golf and baseball hybrid game. The set of golf clubs comprises a plurality of golf clubs for striking the golf and baseball hybrid game ball using a golf-style swing. The baseball-style club is used for striking the golf and baseball hybrid game ball using a baseball-style swing. The golf tee supports the golf and baseball hybrid game ball approximately 1-2 inches off a ground surface for the golf-style swing and the baseball tee supports the golf and baseball hybrid game ball approximately 3-4 feet off the ground surface for the baseball-style swing. As may be appreciated, the set of golf clubs, the baseball-style club(s), the golf tee, the baseball tee, and the golf and baseball hybrid game ball are retrievably-retainable in the hybrid club bag during play.

Similar to conventional golf, a goal of a player of the golf and baseball hybrid game is to advance the golf and baseball hybrid game ball about the golf and baseball hybrid game course in as few of strokes as possible, by using any particular club among the set of golf clubs or the baseball club(s). The golf and baseball hybrid game is played on the hybrid golf and baseball game course according to regulations set forth in the set of golf and baseball hybrid game rules for training and competing in both golf and baseball while exercising different muscles of a body of a player.

The golf and baseball hybrid game may be sold as a kit. The kit may include at least one golf and baseball hybrid game ball, the set of golf clubs including at least one club, at least one wedge, at least one putter, and at least one driver, and at least one baseball-style club, at least one golf tee, the baseball tee, the hybrid club bag, and a set of golf and baseball hybrid game rules.

A method of playing the golf and baseball hybrid game with at least two players may comprise the steps of: step one, selecting a hybrid golf and baseball game course; step two, choosing a golf club or a baseball-style club; step three, swinging the golf club or the baseball-style club to advance a golf and baseball hybrid game ball toward a pin designating a cup of a hole of the hybrid golf and baseball game course; and step four, sinking the golf and baseball hybrid game ball in the cup of the hole in as few strokes as possible. The method of use may further comprise optional steps of: step five, placing the golf and baseball hybrid game ball on a baseball tee for a baseball-style swing; and step six, adjusting the baseball tee to optimally accommodate a height of the player.

The present invention holds significant improvements and serves as an optimal way to combine elements of baseball and golf into a single sport. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, golf and baseball hybrid game, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to Kavemen Golfe Systems and more particularly to a golf and baseball hybrid game providing a fun and unique way to play the game of golf while combining elements of baseball.

Generally speaking, Kaveman Golfe Systems, herein after interchangeably referred to as golf and baseball hybrid game (100), may provide golf enthusiasts, baseball fans, and game aficionados with a unique and updated take on two popular and familiar pastimes. Golf and baseball hybrid game is a new golf game which may be played with a baseball-style club and a regular golf-style club, driver, wedge, and putter. The golf balls may be larger in size, approximately 2" to 3" in diameter (as compared to a traditional golf ball having a diameter of 1.5"). Also provided are golf tees and a taller baseball tee comprising a spring on top for use with the baseball-style club and a larger standard golf tee for the golf-style clubs. The clubs, balls, and tees can be stored in a specially designed golf bag. The course may consist of 11 holes for a complete game and 7 holes for a half game. The distance between the holes may measure approximately 300' to 600' in length, making the game shorter in both distance and time. The course may feature frequent elevation changes, changes in surface from rough to smooth, and many physical obstructions, which require precision and accuracy. A set of rules and instructions detailing how to play may be offered with the equipment.

Figure 1:
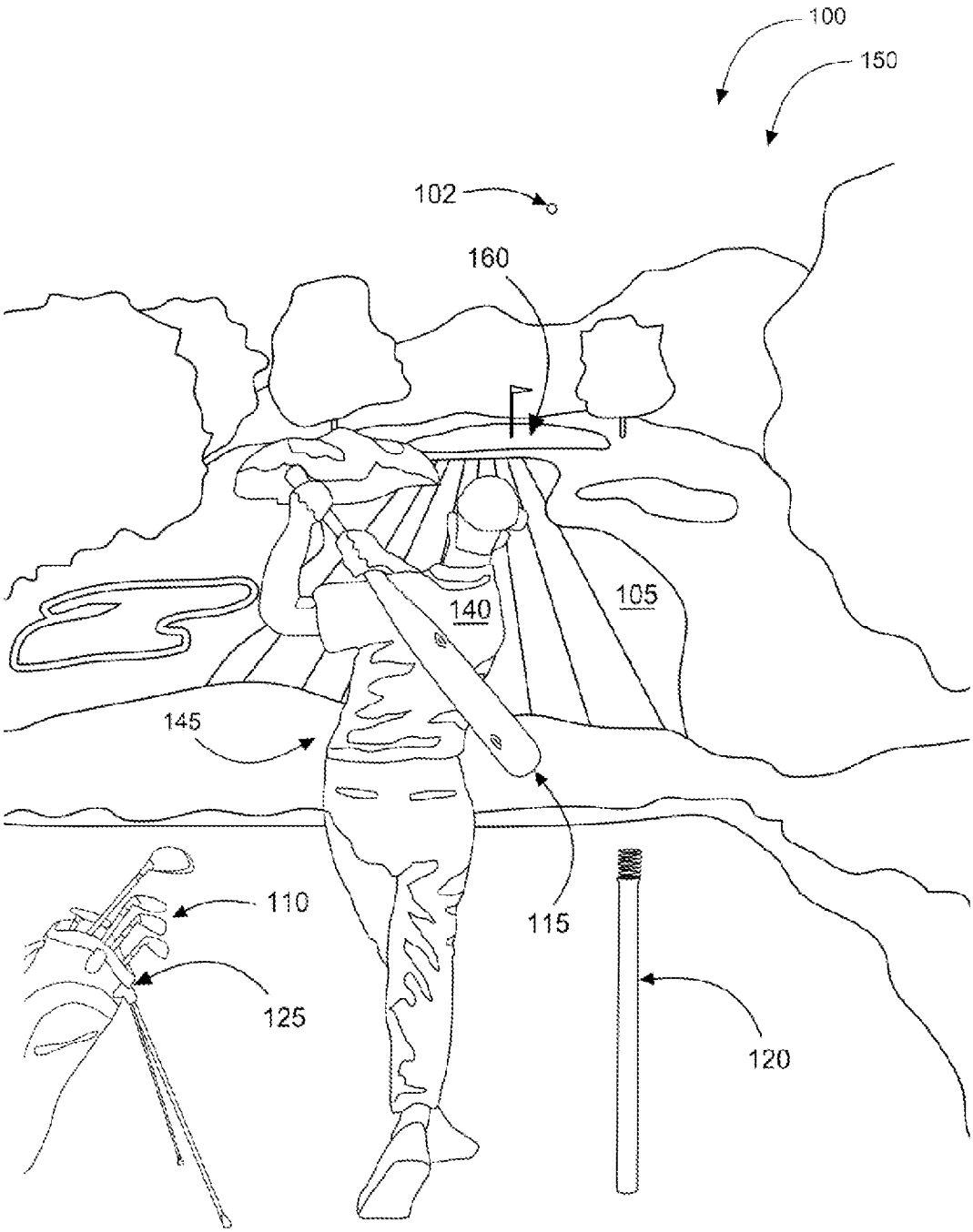
FIG. 1 shows a perspective view illustrating a golf and baseball hybrid game during an 'in-use' condition played on a hybrid golf and baseball game course and showing a first player driving a golf and baseball hybrid game ball using a baseball-style club according to an embodiment of the present invention.

Referring to the drawings by numerals of reference there is shown in FIG. 1, golf and baseball hybrid game 100 during 'in-use' condition 150 being played by first player 140 on hybrid golf and baseball game course 105 according to an embodiment of the present invention. As shown, golf and baseball hybrid game 100 may comprise set of golf clubs 110, baseball-style club 115, golf tee 315, baseball tee 120, golf and baseball hybrid game ball 102, hybrid club bag 125, hybrid golf and baseball game course 105, and a set of golf and baseball hybrid game rules. It should be noted that set of golf clubs 110, baseball-style club 115, golf tee 315, baseball tee 120, golf and baseball hybrid game ball 102, hybrid club bag 125, hybrid golf and baseball game course 105, and the set of golf and baseball hybrid game rules comprises in combination golf and baseball hybrid game 100.

In continuing to refer to FIG. 1, set of golf clubs 110 of golf and baseball hybrid game 100 comprises a plurality of golf clubs for striking golf and baseball hybrid game ball 102 using golf-style swing 445. In addition, golf and baseball hybrid game 100 further comprises baseball-style club 115. As shown in FIG. 1, baseball-style club 115 may be used by first player 140 for striking golf and baseball hybrid game ball 102 using baseball-style swing 145. Baseball tee 120 may be used to hold golf and baseball hybrid game ball 102 approximately 3-4 feet off a ground surface for baseball-style swing 145. As further shown, set of golf clubs 110, baseball-style club 115, golf tee 315, baseball tee 120, and golf and baseball hybrid game ball 102 may be retrievably-retainable in hybrid club bag 125 during 'in-use' condition 150.

In still referring to FIG. 1, hybrid golf and baseball game course 105 of golf and baseball hybrid game 100 may comprise a plurality of hybrid golf and baseball game holes numbered in a sequential order. A primary goal of golf and baseball hybrid game 100 is for first player 140 to advance golf and baseball hybrid game ball 102 about golf and baseball hybrid game course 105 in as few strokes as possible in relation to second player 440. Game play of golf and baseball hybrid game 100 on hybrid golf and baseball game course 105 is played according to regulations set forth in the set of golf and baseball hybrid game rules. It should be appreciated that golf and baseball hybrid game 100 provides a fun and challenging game for training and competing in both golf and baseball while exercising different muscles of a body of first player 140 and second player 440.

Figure 2A:
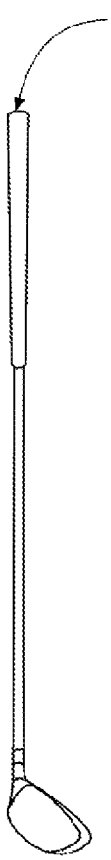
FIG. 2A is a perspective view illustrating a driver of a set of golf clubs of the golf and baseball hybrid game according to an embodiment of the present invention of FIG. 1.

Referring now to FIG. 2A showing a perspective view illustrating driver 205 of set of golf clubs 110 of golf and baseball hybrid game 100 according to an embodiment of the present invention of FIG. 1. As shown, driver 205 may comprise a driver-style club (such as a "wood"). Driver 205 is useful for driving golf and baseball hybrid game ball 102 approximately 100-200 yards via golf-style swing 445. It should be appreciated and understood a driving distance of golf and baseball hybrid game ball 102 via golf-style swing 445 is dependent upon the power and skill of first player 140. It should further be noted that set of golf clubs 110 may comprise more than one driver 205.

Figure 2B:
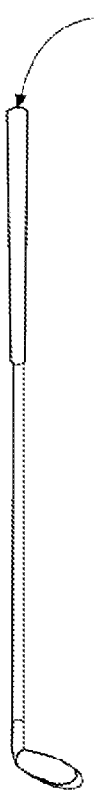
FIG. 2B is a perspective view illustrating a set of golf clubs of the golf and baseball hybrid game according to an embodiment of the present invention of FIG. 1.

Referring now to FIG. 2B showing a perspective view illustrating wood/iron club 210 of set of golf clubs 110 of golf and baseball hybrid game 100 according to an embodiment of the present invention of FIG. 1. As shown, wood/iron club 210 may comprise at least one wood/iron-style club (for example, 3 wood/iron, 4 wood/iron, 9 wood/iron, etc.). Wood/iron club 210 may be useful for both tee offs on shorter holes and for approach shots. It should be appreciated and understood a driving distance of golf and baseball hybrid game ball 102 via golf-style swing 445 is dependent upon the power and skill of first player 140. It should further be noted that set of golf clubs 110 may comprise more than one wood/iron club 210.

Figure 2C:
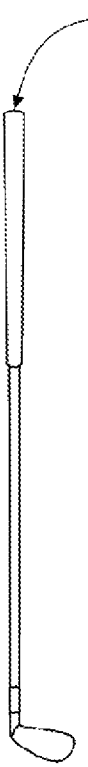
FIG. 2C is a perspective view illustrating a wedge club of a set of golf clubs of the golf and baseball hybrid game according to an embodiment of the present invention of FIG. 1.

Referring now to FIG. 2C showing a perspective view illustrating wedge club 215 of set of golf clubs 110 of golf and baseball hybrid game 100 according to an embodiment of the present invention of FIG. 1. As shown, wedge club 215 may comprise at least one wedge-style club. Wedge club 215 may be useful for hitting golf and baseball hybrid game ball 102 out from hazards and rough terrain via golf-style swing 445. It should be appreciated and understood a driving distance of golf and baseball hybrid game ball 102 via golf-style swing 445 using wedge club 215 is dependent upon the power and skill of first player 140. It should further be noted that set of golf clubs 110 may comprise more than one wedge club 215. Examples of wedge club 215 may include, but are not limited to, pitching wedge, lob wedge, chipper, sand wedge, and other alternative wedge clubs.

Figure 2D:
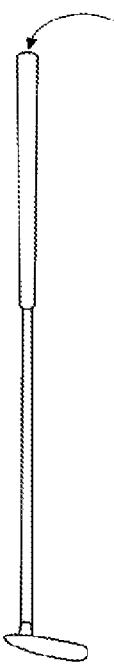
FIG. 2D is a perspective view illustrating a putter of a set of golf clubs of the golf and baseball hybrid game according to an embodiment of the present invention of FIG. 1.

Referring now to FIG. 2D showing a perspective view illustrating putter 220 of set of golf clubs 110 of golf and baseball hybrid game 100 according to an embodiment of the present invention of FIG. 1. As shown, putter 220 may comprise at least one putting-style club. Putter 220 may be useful for striking golf and baseball hybrid game ball 102 when on a green area of hybrid golf and baseball game course 105. It should further be noted that set of golf clubs 110 may comprise more than one putter 220.

In referring generally to FIGS. 2A-2D, it should be noted that set of golf clubs 110 may comprise a variety of sizes and styles to accommodate first player 140. In one embodiment of golf and baseball hybrid game 100, set of golf clubs 110 has a caveman-style appearance which may compliment a trade name of KAVEMAN GOLFE SYSTEMS™. It should also be noted that set of golf clubs 110 and baseball-style club 115 may be manufactured for both right-handed and left-handed users.

Figure 2E:
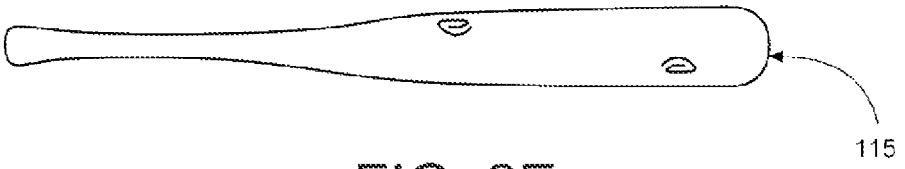
FIG. 2E is a perspective view illustrating the baseball-style club of the golf and baseball hybrid game according to an embodiment of the present invention of FIG. 1.

Referring now to FIG. 2E showing a perspective view illustrating baseball-style club 115 of golf and baseball hybrid game 100 according to an embodiment of the present invention of FIG. 1. As shown, baseball-style club 115 may comprise a club in the form of a baseball bat. In one embodiment, baseball-style club 115 may comprise wood and may aesthetically appear like a club used by a caveman. In other embodiments, baseball-style club 115 may comprise aluminum or plastic. Baseball-style club 115 may be useful for advancing golf and baseball hybrid game ball 102 approximately 100-200 yards via baseball-style swing 145. It should be appreciated and understood that a driving distance of golf and baseball hybrid game ball 102 via baseball-style swing 145 using baseball-style club 115 is dependent upon the power and skill of first player 140. It should further be noted that first player 140 may have access to more than one baseball-style club 115 during play.

Figure 3A:
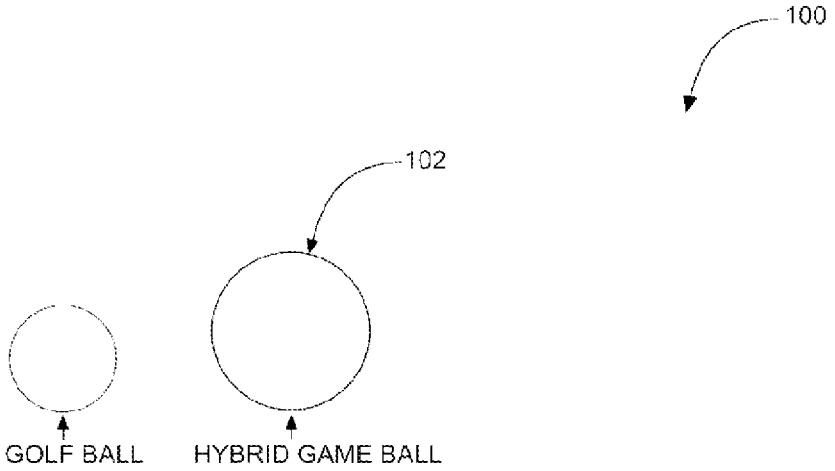
FIG. 3A is a perspective view comparing in size a standard golf ball and the golf and baseball hybrid game ball according to an embodiment of the present invention of FIG. 1.

Referring now to FIG. 3A showing a perspective view comparing in size a standard golf ball and golf and baseball hybrid game ball 102 according to an embodiment of the present invention of FIG. 1. As shown, the standard golf ball comprises a diameter of approximately 1.5". According to a preferred embodiment of golf and baseball hybrid game 100, golf and baseball hybrid game ball 102 may comprise a diameter of approximately 2.5" in diameter. In other embodiments, golf and baseball hybrid game ball 102 comprises a diameter of approximately 2" to 3". In such a manner, golf and baseball hybrid game ball 102 is larger than the traditional golf ball such that golf and baseball hybrid game ball 102 is readily visible during play by first player 140 and second player 440. Similar to the standard golf ball, golf and baseball hybrid game ball 102 may comprise dimples which may serve to add spin and wind resistance during 'in-use' condition 150.

Figure 3B:
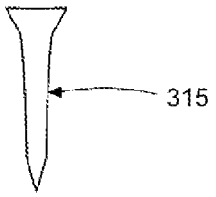
FIG. 3B is a perspective view illustrating a golf tee useful for holding the golf and baseball hybrid game ball for a golf-style swing according to an embodiment of the present invention of FIG. 1.

Referring now to FIG. 3B showing a perspective view illustrating golf tee 315 useful for holding golf and baseball hybrid game ball 102 for golf-style swing 445 according to an embodiment of the present invention of FIG. 1. As shown, golf tee 315 may comprise a ground-insertable tee having a recessed holding area for golf and baseball hybrid game ball 102. In one embodiment, golf tee 315 may comprise a larger recessed holding area to accommodate the slightly larger golf and baseball hybrid game ball 102 (as compared to the standard size golf ball). Golf tee 315 may be used by first player 140 during play when teeing off on one of the hybrid golf and baseball game holes of hybrid golf and baseball game course 105.

Figure 3C:
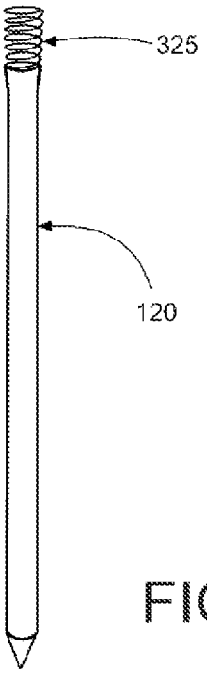
FIG. 3C is a perspective view illustrating a baseball tee useful for holding the golf and baseball hybrid game ball for a baseball-style swing according to an embodiment of the present invention of FIG. 1.

Referring now to FIG. 3C showing a perspective view illustrating baseball tee 120 useful for holding golf and baseball hybrid game ball 102 for baseball-style swing 145 according to an embodiment of the present invention of FIG. 1. As shown, baseball tee 120 may comprise a stand, a vertical support member, and spring 325 located atop baseball tee 120. A bottom of the vertical support member may be mounted to the stand, and spring 325 may be connected to a top of the vertical support member. During use, golf and baseball hybrid game ball 102 is placeable on spring 325 of baseball tee 120. As may be appreciated, spring 325 is useful for holding golf and baseball hybrid game ball 102 during baseball-style swing 145.

In continuing to refer to FIG. 3C, baseball tee 120 of golf and baseball hybrid game 100 may further comprise adjustable slide 330. As shown, adjustable slide 330 may comprise a tube member in a telescopic relationship with the vertical support member of baseball tee 120. In use, first player 140 or second player 440 may vertically-manipulate adjustable slide 330 up or down to accommodate a relative stature of first player 140, and second player 440 for optimizing baseball-style swing 145. It should be understood baseball tee 120 may of course accommodate additional players playing golf and baseball hybrid game 100.

Figure 4:
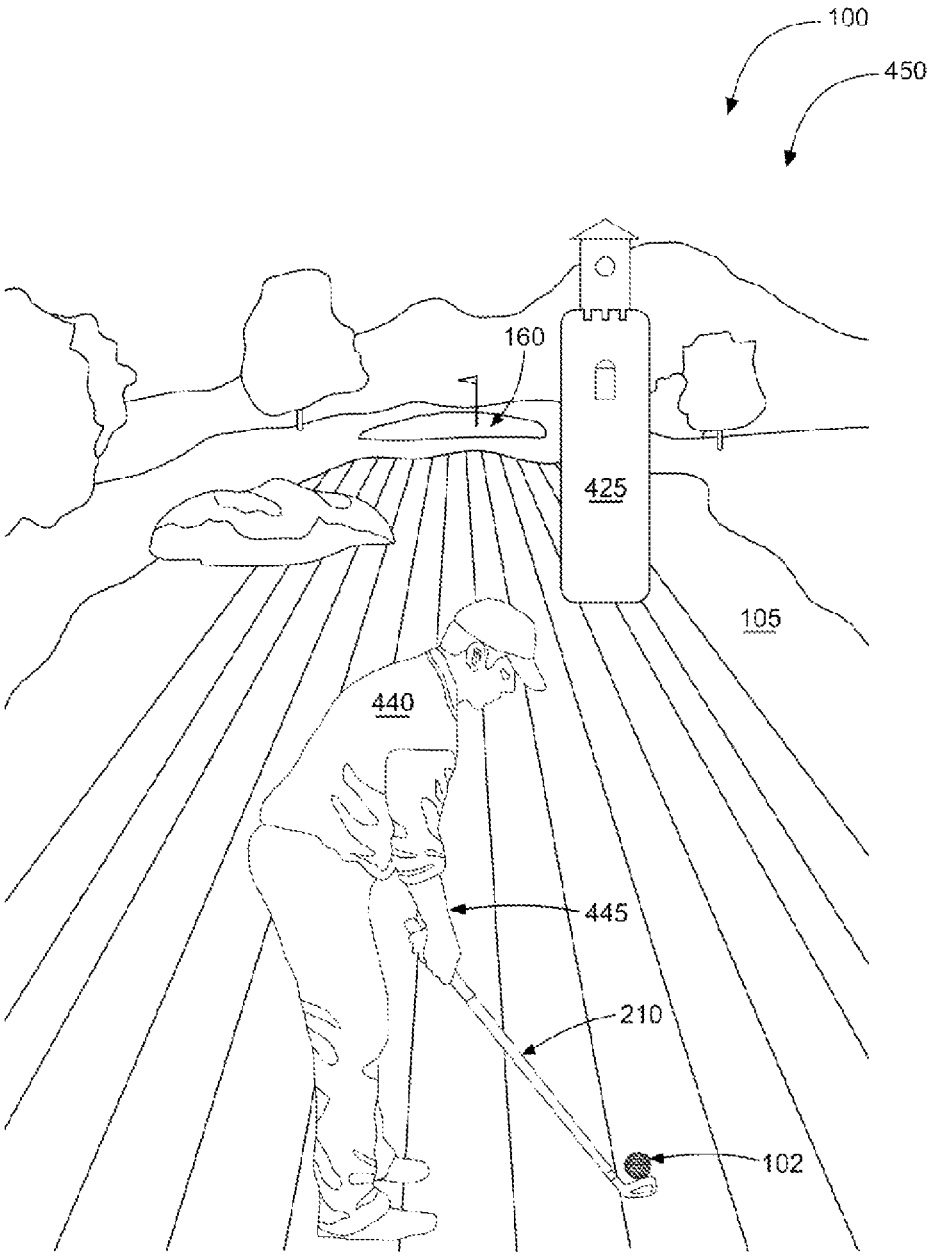
FIG. 4 is a perspective view illustrating the golf and baseball hybrid game during an 'in-use' condition played on the hybrid golf and baseball game course and showing a second player driving the golf and baseball hybrid game ball using the club of the set of golf clubs according to an embodiment of the present invention of FIG. 1.

Referring now to FIG. 4 showing a perspective view illustrating golf and baseball hybrid game 100 during 'in-use' condition 450 played on hybrid golf and baseball game course 105 according to an embodiment of the present invention of FIG. 1. Second player 440 is shown driving golf and baseball hybrid game ball 102 using iron/wood club 210 of set of golf clubs 110 via golf-style swing 445. In one version of play of golf and baseball hybrid game 100, hybrid golf and baseball game course 105 comprises rugged terrain. As seen in FIG. 4, the rugged terrain may comprise physical obstruction 425. Physical obstruction 425 may comprise a natural or an artificial impediment located on hybrid golf and baseball game course 105. Furthermore, the rugged terrain may comprise frequent elevation changes and other traps and hazards. It should be appreciated that a relative difficulty of hybrid golf and baseball game course 105 is varied based not only on a distance of each hole but also various types of rugged terrain which may make golf and baseball hybrid game 100 more fun and challenging for first player 140 and second player 440. It should also be noted that hybrid golf and baseball game course 105 may also comprise non-rugged terrain.

In a preferred embodiment of golf and baseball hybrid game 100, hybrid golf and baseball game course 105 comprises eleven (11) holes of competition. In other embodiments, hybrid golf and baseball game course 105 may comprise more or less than eleven (11) holes.

Figure 5:
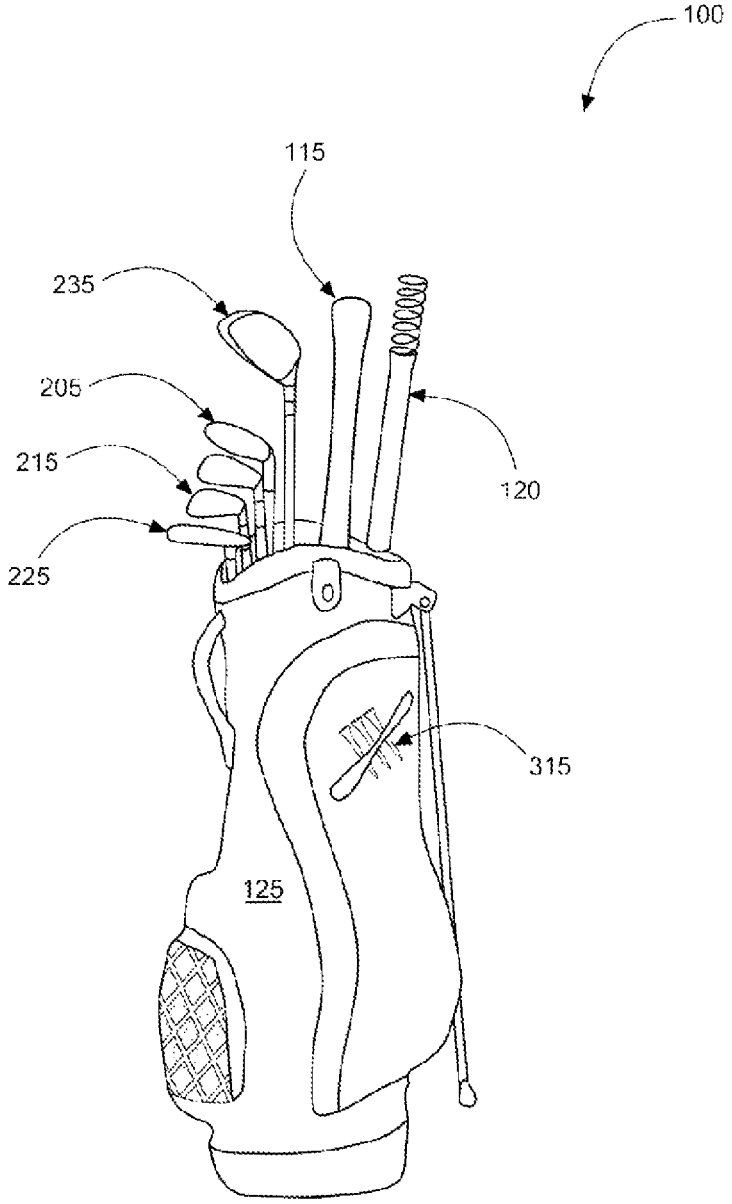
FIG. 5 is a perspective view illustrating a hybrid club bag useful for holding the various clubs, balls, tees, and other accessories of the golf and baseball hybrid game according to an embodiment of the present invention of FIG. 1.

Referring now to FIG. 5 showing a perspective view illustrating hybrid club bag 125 according to an embodiment of the present invention of FIG. 1. As shown, hybrid club bag 125 may comprise a larger-than-standard golf-type bag which is useful for holding set of golf clubs 110, golf and baseball hybrid game ball(s) 102, baseball-style club 115, baseball tee 120, golf tee(s) 315, and other player accessories of golf and baseball hybrid game 100. Preferably, hybrid club bag 125 comprises at least one handle, a shoulder strap, a plurality of zippered pockets, holding compartments, a hollow cavity for removably-retaining set of golf clubs 110, baseball-style club 115, and baseball tee 120, and a fold-out stand for vertically supporting hybrid club bag 125 during play. Hybrid club bag 125 may be formed of durable and weatherproof material for continued use and enjoyment. It should be appreciated hybrid club bag 125 that may be manufactured in a variety of colors and styles.

Golf and baseball hybrid game 100 may be sold as kit 575 comprising the following parts: at least one golf and baseball hybrid game ball 102; at least one set of golf clubs 110 comprising at least one driver 205, at least one iron/wood club 210, at least one wedge club 215, and at least one putter 220; at least one baseball-style club 115; at least one baseball tee 120; at least one golf tee 315; hybrid club bag 125; at least one hybrid golf and baseball game course 105 for playing golf and baseball hybrid game 100; and at least one set of user instructions. Kit 575 has instructions such that functional relationships are detailed in relation to the structure of the invention (such that the invention can be used, maintained, or the like in a preferred manner). Golf and baseball hybrid game 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different club combinations, parts may be sold separately, etc., may be sufficient.

Figure 6:
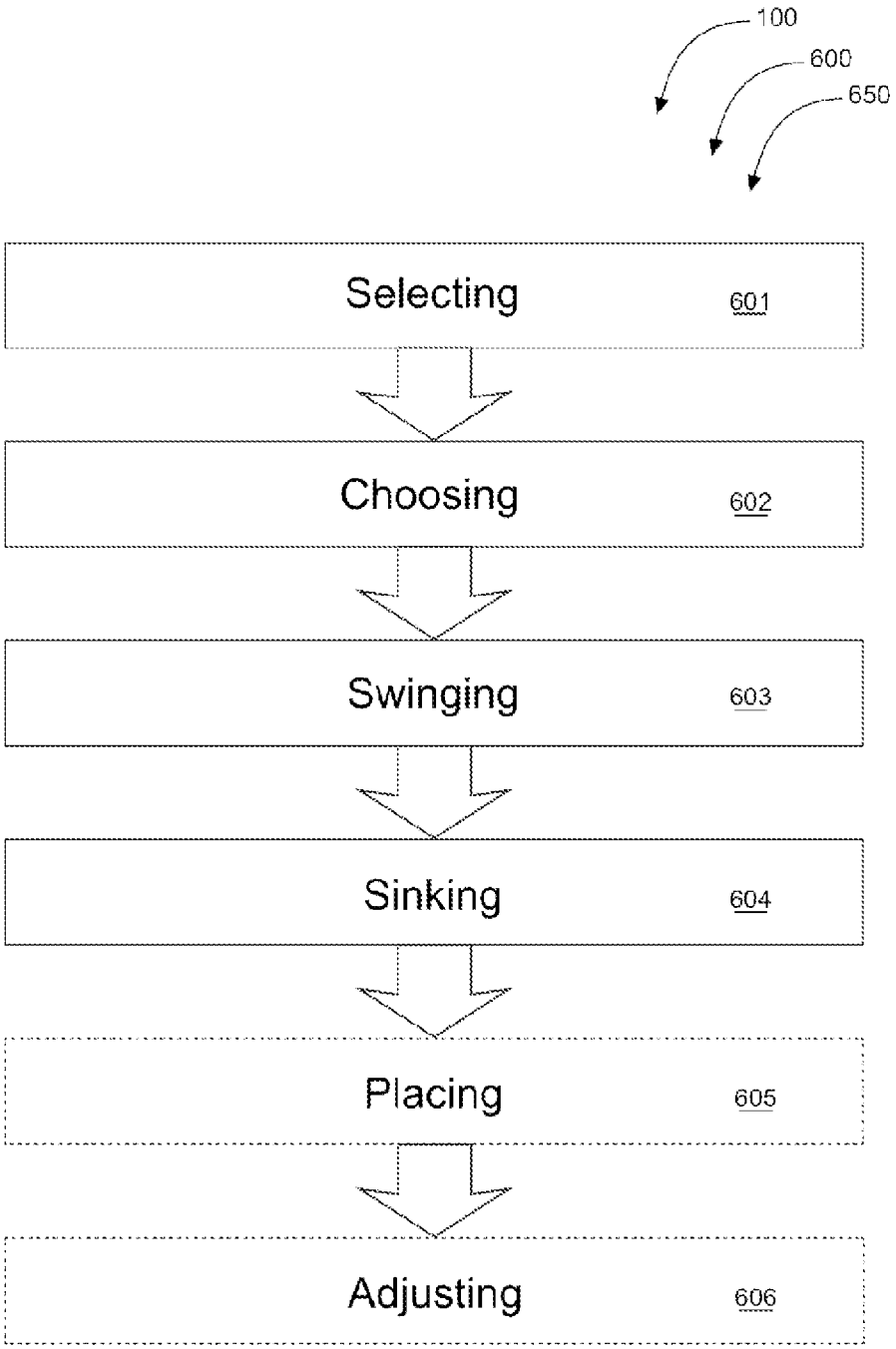
FIG. 6 is a flowchart illustrating a method of use for the golf and baseball hybrid game according to an embodiment of the present invention of FIGS. 1-5.

Referring now to FIG. 6 showing flowchart 650 illustrating method of use 600 for golf and baseball hybrid game 100 according to an embodiment of the present invention of FIGS. 1-5.

Method of use 600 for playing a golf and baseball hybrid game 100 with at least two players may comprise the steps of: step one 601, selecting hybrid golf and baseball game course 105; step two 602, choosing a golf club from set of golf clubs 110 or baseball-style club 115; step three 603, swinging the golf club or baseball-style club 115 to advance golf and baseball hybrid game ball 102 toward a pin designating a cup of a hole of hybrid golf and baseball game course 105; and step four 604, sinking golf and baseball hybrid game ball 102 in the cup of the hole in as few strokes as possible. A winner of golf and baseball hybrid game 100 may be the player who completed hybrid golf and baseball game course 105 in fewer strokes than the other players.

Method of use 600 may further comprise the optional steps of: step five 605, placing golf and baseball hybrid game ball 102 on baseball tee 120 for baseball-style swing 145 using baseball-style club 115; and step six 606, vertically adjusting baseball tee 120 to optimally accommodate a height of first player 140 or second player 440. It should be noted that step five 605 and step six 606 are optional steps and may not be implemented in all cases. Optional steps of method of use 600 are illustrated using dotted lines in FIG. 6 so as to distinguish them from the other steps of method of use 600.

It should be noted that the steps described in the method of use can be carried out in many different orders according to user preference. The use of "step of" should not be interpreted as "step for", in the claims herein and is not intended to invoke the provisions of 35 U.S.C. §112, 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A golf and baseball hybrid game comprising:

at least one set of golf clubs;

at least one baseball-style club;

at least one golf tee;

at least one baseball tee;

at least one golf and baseball hybrid game ball;

at least one hybrid club bag;

a hybrid golf and baseball game course; and a set of golf and baseball hybrid game rules;

wherein said at least one set of golf clubs, said at least one baseball-style club, said at least one golf tee, said at least one baseball tee, said at least one golf and baseball hybrid game ball, said at least one hybrid club bag, and said hybrid golf and baseball game course comprises in combination said golf and baseball hybrid game;

wherein said at least one set of golf clubs comprises a plurality of golf clubs for striking said golf and baseball hybrid game ball using a golf-style swing;

wherein said at least one baseball-style club is used for striking said golf and baseball hybrid game ball using a baseball-style swing;

wherein said golf tee supports said golf and baseball hybrid game ball inches off a ground surface for said golf-style swing;

wherein said baseball tee supports said golf and baseball hybrid game ball approximately 3-4 feet off said ground surface for said baseball-style swing;

wherein said at least one set of golf clubs, said at least one baseball-style club, said at least one golf tee, said at least one baseball tee, and said at least one golf and baseball hybrid game ball are retrievably-retainable in said at least one hybrid club bag during play;

wherein said hybrid golf and baseball game course comprises a plurality of hybrid golf and baseball game holes numbered in a sequential order;

wherein a goal of a first player of said golf and baseball hybrid game is to advance said golf and baseball hybrid game ball about said golf and baseball hybrid game course in as few of strokes as possible in relation to a second player; and wherein said golf and baseball hybrid game is played on said hybrid golf and baseball game course according to regulations set forth in said set of golf and baseball hybrid game rules for training and competing in both golf and baseball while exercising different muscles of a body of at least said first player and said second player.

2. The golf and baseball hybrid game of claim 1 wherein said at least one golf and baseball hybrid game ball comprises dimensions of approximately 2" to 3" in diameter.

3. The golf and baseball hybrid game of claim 2 wherein said at least one golf and baseball hybrid game ball is larger than a traditional golf ball such that said at least one golf and baseball hybrid game ball is readily visible during play by at least said first player and said second player.

4. The golf and baseball hybrid game of claim 3 wherein said baseball-style club is useful for advancing said golf and baseball hybrid game ball approximately 100-200 yards via said baseball-style swing.

5. The golf and baseball hybrid game of claim 4 wherein said at least one baseball tee comprises a spring mounted to a top of said at least one baseball tee.

6. The golf and baseball hybrid game of claim 5 wherein said spring is useful for holding said at least one golf and baseball hybrid game ball during said baseball-style swing.

7. The golf and baseball hybrid game of claim 6 wherein said at least one baseball tee is vertically adjustable to accommodate a relative stature of at least said first player, and said second player.

8. The golf and baseball hybrid game of claim 6 wherein said at least one set of golf clubs comprises at least one iron/wood club, said iron/wood club useful for approach shots.

9. The golf and baseball hybrid game of claim 6 wherein said at least one set of golf clubs comprises at least one wedge club, said at least one wedge club useful for hazards and rough terrain via said golf-style swing.

10. The golf and baseball hybrid game of claim 6 wherein said at least one set of golf clubs comprises at least one putter, said putter useful for striking said golf and baseball hybrid game ball when on a green area of said hybrid golf and baseball game course.

11. The golf and baseball hybrid game of claim 6 wherein said at least one set of golf clubs comprises at least one driver, said driver useful for driving said golf and baseball hybrid game ball approximately 100-200 yards via said golf-style swing.

12. The golf and baseball hybrid game of claim 1 wherein said hybrid golf and baseball game course comprises rugged terrain.

13. The golf and baseball hybrid game of claim 12 wherein said rugged terrain comprises frequent elevation changes.

14. The golf and baseball hybrid game of claim 12 wherein said rugged terrain comprises physical obstructions.

15. The golf and baseball hybrid game of claim 1 wherein said hybrid golf and baseball game course comprises non-rugged terrain.

16. The golf and baseball hybrid game of claim 1 wherein said golf and baseball hybrid game is played on said hybrid golf and baseball game course having eleven of said holes.

17. A golf and baseball hybrid game comprising:

at least one golf and baseball hybrid game ball comprising dimensions of approximately 2" to 3" in diameter, said at least one golf and baseball hybrid game ball being larger in size than a traditional golf ball such that said at least one golf and baseball hybrid game ball is readily visible during play by at least a first player and a second player;

at least one set of golf clubs comprising at least one iron/wood club, said iron/wood club useful for approach shots, said at least one set of golf clubs also comprising at least one wedge club, said at least one wedge club useful for hazards and rough terrain via a golf-style swing, said at least one set of golf clubs also comprising at least one putter, said putter useful for striking said golf and baseball hybrid game ball when on a green area of said hybrid golf and baseball game course, and said at least one set of golf clubs also comprising at least one driver, said driver useful for driving said golf and baseball hybrid game ball approximately 100-200 yards via said golf-style swing;

at least one baseball-style club, said baseball-style club useful for advancing said golf and baseball hybrid game ball approximately 100-200 yards via a baseball-style swing;

at least one golf tee;

at least one baseball tee, said at least one baseball tee comprises a spring mounted to a top, said spring useful for holding said at least one golf and baseball hybrid game ball during said baseball-style swing, said at least one baseball tee being vertically adjustable to accommodate a relative stature of at least said first player, and said second player;

at least one hybrid club bag;

a hybrid golf and baseball game course, said golf and baseball hybrid game is playable on said hybrid golf and baseball game course having eleven holes, said hybrid golf and baseball game course comprising rugged terrain, said rugged terrain comprising frequent elevation changes and physical obstructions, said hybrid golf and baseball game course also comprising non-rugged terrain; and a set of golf and baseball hybrid game rules defining regulations and objectives of said golf and baseball hybrid game;

wherein said at least one set of golf clubs, said at least one baseball-style club, said at least one golf tee, said at least one baseball tee, said at least one golf and baseball hybrid game ball, said at least one hybrid club bag, and said hybrid golf and baseball game course comprises in combination said golf and baseball hybrid game;

wherein said at least one set of golf clubs comprises a plurality of golf clubs for striking said golf and baseball hybrid game ball using a golf-style swing;

wherein said at least one baseball-style club is used for striking said golf and baseball hybrid game ball using a baseball-style swing;

wherein said golf tee supports said golf and baseball hybrid game ball inches off a ground surface for said golf-style swing;

wherein said baseball tee supports said golf and baseball hybrid game ball 3-4 feet off said ground surface for said baseball-style swing;

wherein said at least one set of golf clubs, said at least one baseball-style club, said at least one golf tee, said at least one baseball tee, and said at least one golf and baseball hybrid game ball are retrievably-retainable in said at least one hybrid club bag during play;

wherein said hybrid golf and baseball game course comprises a plurality of hybrid golf and baseball game holes numbered in a sequential order;

wherein a goal of a player of said golf and baseball hybrid game is to advance said golf and baseball hybrid game ball about said golf and baseball hybrid game course in as few of strokes as possible; and wherein said golf and baseball hybrid game is played on said hybrid golf and baseball game course according to regulations set forth in said set of golf and baseball hybrid game rules for training and competing in both golf and baseball while exercising different muscles of a body of a player.

18. The golf and baseball hybrid game of claim 17 further comprising a kit including:

said at least one golf and baseball hybrid game ball;

said at least one set of golf clubs including said at least one club, said at least one wedge, said at least one putter, and said at least one driver;

said at least one baseball-style club;

said at least one golf tee;

said at least one baseball tee;

said at least one hybrid club bag; and a set of golf and baseball hybrid game rules.

* * * * *